US010323214B2

(12) United States Patent
Cermenati et al.

(10) Patent No.: US 10,323,214 B2
(45) Date of Patent: Jun. 18, 2019

(54) ANTIMICROBIAL HARD SURFACE CLEANING COMPOSITIONS PROVIDING IMPROVED GREASE REMOVAL

(71) Applicant: The Procter & Gamble Company, Cincinnati, OH (US)

(72) Inventors: Laura Cermenati, Brussels (BE); Raphael Angeline Alfons Ceulemans, Holsbek (BE); Ann Vandevenne, Putte (BE)

(73) Assignee: The Procter & Gamble Company, Cincinnati, OH (US)

( * ) Notice: Subject to any disclaimer, the term of this patent is extended or adjusted under 35 U.S.C. 154(b) by 53 days.

(21) Appl. No.: 15/376,693

(22) Filed: Dec. 13, 2016

(65) Prior Publication Data

US 2017/0175036 A1 Jun. 22, 2017

(30) Foreign Application Priority Data

Dec. 22, 2015 (EP) ..... 15201809
Aug. 22, 2016 (EP) ..... 16185113

(51) Int. Cl.

| | |
|---|---|
| ***C11D 3/30*** | (2006.01) |
| ***C11D 1/835*** | (2006.01) |
| ***C11D 3/20*** | (2006.01) |
| ***C11D 1/722*** | (2006.01) |
| ***C11D 1/62*** | (2006.01) |
| ***C11D 1/66*** | (2006.01) |
| ***C11D 1/75*** | (2006.01) |
| ***C11D 3/48*** | (2006.01) |
| ***C11D 11/00*** | (2006.01) |
| ***C11D 1/72*** | (2006.01) |
| ***C11D 1/825*** | (2006.01) |
| ***C11D 1/83*** | (2006.01) |

(52) U.S. Cl.

CPC ..... *C11D 3/30* (2013.01); *C11D 1/62* (2013.01); *C11D 1/66* (2013.01); *C11D 1/72* (2013.01); *C11D 1/722* (2013.01); *C11D 1/75* (2013.01); *C11D 1/825* (2013.01); *C11D 1/83* (2013.01); *C11D 1/835* (2013.01); *C11D 3/2006* (2013.01); *C11D 3/2041* (2013.01); *C11D 3/2068* (2013.01); *C11D 3/48* (2013.01); *C11D 11/0023* (2013.01)

(58) Field of Classification Search

CPC .. C11D 1/75; C11D 1/722; C11D 1/72; C11D 1/835; C11D 1/62; C11D 3/2006; C11D 3/2068; C11D 3/2041

USPC ..... 510/238, 423, 427, 432, 433, 503, 504, 510/505, 506

See application file for complete search history.

(56) References Cited

U.S. PATENT DOCUMENTS

| | | | | |
|---|---|---|---|---|
| 4,065,409 | A | 12/1977 | Flanagan | |
| 5,948,742 | A | 9/1999 | Chang et al. | |
| 6,180,585 | B1 | 1/2001 | Schalitz et al. | |
| 6,270,754 | B1 * | 8/2001 | Zhou | A01N 33/12 424/405 |
| 6,528,070 | B1 | 3/2003 | Bratescu et al. | |
| 8,288,331 | B2 | 10/2012 | Hanai et al. | |
| 2,447,349 | A1 | 1/2014 | De Leersnyder et al. | |
| 8,933,010 | B2 | 1/2015 | Scheuing et al. | |
| 2001/0049347 | A1 * | 12/2001 | Robbins | C11D 1/835 510/238 |
| 2002/0103098 | A1 * | 8/2002 | Harrison | C11D 1/86 510/382 |
| 2003/0064910 | A1 * | 4/2003 | Fong | C11D 1/62 510/421 |
| 2003/0100465 | A1 * | 5/2003 | Kilkenny | A01N 33/12 510/384 |
| 2003/0114342 | A1 * | 6/2003 | Hall | A01N 33/12 510/391 |
| 2006/0154840 | A1 | 7/2006 | Yagi et al. | |
| 2006/0205619 | A1 | 9/2006 | Mayhall et al. | |
| 2008/0293619 | A1 | 11/2008 | Chakrabarty et al. | |
| 2009/0318322 | A1 | 12/2009 | Taylor et al. | |
| 2010/0160201 | A1 * | 6/2010 | Scheuing | C11D 1/83 510/180 |
| 2011/0230387 | A1 | 9/2011 | Leyrer et al. | |
| 2012/0213759 | A1 * | 8/2012 | Karsten | C11D 1/62 424/94.1 |
| 2012/0276219 | A1 | 11/2012 | Taylor et al. | |
| 2013/0029895 | A1 * | 1/2013 | Bettiol | C11D 3/1266 510/236 |
| 2013/0273174 | A1 | 10/2013 | Scheuing et al. | |
| 2014/0073546 | A1 | 3/2014 | Khan | |
| 2015/0073051 | A1 | 3/2015 | Cohen et al. | |
| 2015/0203799 | A1 | 7/2015 | Bettiol et al. | |
| 2015/0264922 | A1 | 9/2015 | Scheuing | |

(Continued)

FOREIGN PATENT DOCUMENTS

| | | | |
|---|---|---|---|
| WO | WO 99/19438 | A1 | 4/1999 |
| WO | WO 2004/026271 | A1 | 4/2004 |
| WO | WO 2014/026859 | A1 | 2/2014 |

OTHER PUBLICATIONS

Extended European Search Report; Application No. 15201809.9-1358; dated Jun. 13, 2016; 6 pages.

(Continued)

*Primary Examiner* — Gregory R Delcotto

(74) *Attorney, Agent, or Firm* — John T. Dipre

(57) ABSTRACT

The need for a liquid hard surface cleaning composition which provides antimicrobial efficacy and good cleaning is met by formulating the composition using an antimicrobial active in combination with an amine oxide surfactant and additional non-ionic surfactant at the desired ratio.

15 Claims, No Drawings

(56) References Cited

U.S. PATENT DOCUMENTS

| | | | |
|---|---|---|---|
| 2015/0315527 | A1 | 11/2015 | Malaba et al. |
| 2016/0068620 | A1 | 3/2016 | Tamareselvy et al. |
| 2016/0108340 | A1 | 4/2016 | Feng et al. |
| 2016/0186095 | A1 | 6/2016 | Vockenroth et al. |
| 2017/0175041 | A1 | 6/2017 | Ahirwal et al. |

OTHER PUBLICATIONS

Extended European Search Report; Application No. 15201807.3-1358; dated Jun. 13, 2016; 7 pages.
U.S. Appl. No. 15/376,699, filed Dec. 13, 2016, Ahirwal, et al.

* cited by examiner

ANTIMICROBIAL HARD SURFACE CLEANING COMPOSITIONS PROVIDING IMPROVED GREASE REMOVAL

FIELD OF THE INVENTION

A liquid hard surface cleaning composition comprising an antimicrobial agent, an amine oxide surfactant and an additional non-ionic surfactant, which provides antimicrobial benefit in combination with improved grease removal.

BACKGROUND OF THE INVENTION

Hard surface cleaning compositions are used for cleaning and treating hard surfaces. Preferably, the hard surface cleaning composition is formulated to be an "all purpose" hard surface cleaning composition. That is, the hard surface cleaning composition is formulated to be suitable for cleaning as many different kinds of surfaces as possible.

For treating surfaces where high levels of hygiene is desired, such as toilets, bathrooms, and surfaces that small infants can come into contact with, it is desirable that the hard surface cleaning composition comprises an anti-bacterial agent such as a quaternary ammonium compound. However, such antimicrobial agents inhibit the cleaning efficacy of surfactants, leading to less than ideal cleaning, especially grease cleaning, and less than ideal shine. Moreover, since surfactants can result in the antimicrobial agent being "captured" within micelles, antimicrobial efficacy is typically affected by the presence of surfactants since less free antimicrobial agent is available. Moreover, since antimicrobial efficacy can be influenced by surfactant concentration, it can be challenging to formulate antimicrobial hard surface cleaning compositions which are effective during both direct (neat) application, and also when applied diluted. This is particularly the case where heavy grease is present, such as on some kitchen surfaces. As such, a need remains for a hard surface cleaning composition which provides good antimicrobial efficacy, in addition to improved grease removal and shine, both during neat and dilute application.

EP2447349 B1 relates to a thickened alkaline liquid hard surface cleaning composition comprising a surfactant system and chelant to provide cleaning and shine. WO2014070201 A1 (Clorox) discloses cationic micelles with anionic polymeric counterions compositions, methods and systems thereof. WO 2014/026859 (Henkel) relates to a liquid textile or hard surface treatment agent comprising: at least one nonionic and a cationic biocidal compound. WO2007/079022 (Dial) discloses compositions comprising benzethonium chloride as an antimicrobial agent. WO 2013/148247 (Gojo), WO 99/19438 (Stepan), and EP 1 905 819 A 1 (Kao) disclose compositions which comprise alkyl dimethyl benzyl ammonium chloride, but not blends of alkyl dimethyl benzyl ammonium chloride and alkyl dimethyl ethylbenzyl ammonium chloride.

SUMMARY OF THE INVENTION

The present invention relates to a hard surface cleaning composition comprising: from 0.001 wt % to less than 2 wt % of an antimicrobial agent, wherein the antimicrobial agent is a quaternary ammonium compound, wherein the quaternary ammonium compound is selected from the group consisting of: didecyl dimethyl ammonium chloride, a blend of alkyl dimethyl benzyl ammonium chloride and alkyl dimethyl ethylbenzyl ammonium chloride, and mixtures thereof; from 0.01 wt % to 5.0 wt % of an amine oxide surfactant; greater than 2 wt % of an additional non-ionic surfactant; and less than 1 wt % of anionic surfactant; wherein the ratio of amine oxide surfactant to the sum of amine oxide surfactant and additional non-ionic surfactant is from 0.05 to 0.5.

The present invention further relates to a method of cleaning surfaces, comprising the steps of: diluting a liquid hard surface cleaning composition of the present invention, and applying the diluted composition to a hard surface. The present invention further relates to a method of cleaning stained surfaces, comprising the step of applying neat to the hard surface, especially to the stained part of the hard surface.

The present invention further relates to the use of amine oxide surfactants in compositions comprising an antimicrobial agent, preferably compositions according to any of claims 1 to 13, to improve shine or improve kitchen dirt removal, or improve grease removal from a treated surface.

DETAILED DESCRIPTION OF THE INVENTION

Hard surface cleaning compositions of the present invention, comprising an antimicrobial agent, an amine oxide surfactant and an additional non-ionic surfactant, provide improved grease removal and surface shine, while maintaining antimicrobial efficacy during both neat and dilute application.

As defined herein, "essentially free of" a component means that no amount of that component is deliberately incorporated into the respective premix, or composition. Preferably, "essentially free of" a component means that no amount of that component is present in the respective premix, or composition.

As used herein, "isotropic" means a clear mixture, having little or no visible haziness, phase separation and/or dispersed particles, and having a uniform transparent appearance.

All percentages, ratios and proportions used herein are by weight percent of the composition, unless otherwise specified. All average values are calculated "by weight" of the composition, unless otherwise expressly indicated. All ratios are calculated as a weight/weight level, unless otherwise specified.

All measurements are performed at 25° C. unless otherwise specified.

Unless otherwise noted, all component or composition levels are in reference to the active portion of that component or composition, and are exclusive of impurities, for example, residual solvents or by-products, which may be present in commercially available sources of such components or compositions.

Liquid Hard Surface Cleaning Compositions:

By "liquid hard surface cleaning composition", it is meant herein a liquid composition for cleaning hard surfaces found in households, especially domestic households. Surfaces to be cleaned include kitchens and bathrooms, e.g., floors, walls, tiles, windows, cupboards, sinks, showers, shower plastified curtains, wash basins, WCs, fixtures and fittings and the like made of different materials like ceramic, vinyl, no-wax vinyl, linoleum, melamine, glass, steel, kitchen work surfaces, any plastics, plastified wood, metal or any painted or varnished or sealed surface and the like. Household hard surfaces also include household appliances including, but not limited to refrigerators, freezers, washing machines, automatic dryers, ovens, microwave ovens, dishwashers and so on. Such hard surfaces may be found both in private households as well as in commercial, institutional and industrial environments.

In a preferred embodiment, the liquid compositions herein are aqueous compositions. Therefore, they may comprise from 30% to 99.5% by weight of the total composition of water, preferably from 50% to 98% and more preferably from 80% to 96%.

The compositions of the present invention preferably have a viscosity of from 50 Pa·s to 1200 Pa·s, more preferably 100 Pa·s to 800 Pa·s, most preferably 200 Pa·s to 600 Pa·s when measured at a temperature of 20° C. with a AD1000 Advanced Rheometer from Atlas® using a shear rate of 10 s-1 with a coned spindle of 40 mm with a cone angle 2° and a truncation of ±60 μm.

The pH of the compositions herein is from 9.0 to 13.0, preferably from 9.5 to 12, more preferably from 10.0 to 11.5. The greasy soil and particulate greasy soil cleaning performance is further improved at these preferred alkaline pH ranges. Accordingly, the compositions herein may further comprise an acid or base to adjust pH as appropriate.

A suitable acid for use herein is an organic and/or an inorganic acid. A preferred organic acid for use herein has a pka of less than 6. A suitable organic acid is selected from the group consisting of citric acid, lactic acid, glycolic acid, succinic acid, glutaric acid and adipic acid and mixtures thereof. A mixture of said acids may be commercially available from BASF under the trade name Sokalan® DCS. A suitable inorganic acid is selected from the group consisting hydrochloric acid, sulphuric acid, phosphoric acid, and mixtures thereof.

A typical level of acid, when present, is of from 0.01% to 5.0% by weight of the total composition, preferably from 0.04% to 3.0% and more preferably from 0.05% to 1.5%.

A suitable base to be used herein is an organic and/or inorganic base. Suitable bases for use herein are the caustic alkalis, such as sodium hydroxide, potassium hydroxide and/or lithium hydroxide, and/or the alkali metal oxides such, as sodium and/or potassium oxide or mixtures thereof. A preferred base is a caustic alkali, more preferably sodium hydroxide and/or potassium hydroxide.

Other suitable bases include ammonia, ammonium carbonate, $K_2CO_3$, $Na_2CO_3$ and alkanolamines (as e.g. monoethanolamine).

Typical levels of base, when present, are of from 0.01% to 5.0% by weight of the total composition, preferably from 0.05% to 3.0% and more preferably from 0.08% to 2.5%.

Antimicrobial Agent:

The antimicrobial agent is a quaternary ammonium compound, wherein the quaternary ammonium compound is selected from the group consisting of: didecyl dimethyl ammonium chloride, a blend of alkyl dimethyl benzyl ammonium chloride and alkyl dimethyl ethylbenzyl ammonium chloride, and mixtures thereof.

The quaternary ammonium compounds used in the compositions of the invention have the structural formula:

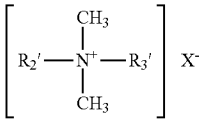

wherein $R_2'$ and $R_3'$ are C10, or $R_2'$ is alkyl, preferably C12-C18 alkyl, and $R_3'$ is benzyl or ethyl benzyl. X is a halide, for example a chloride, bromide or iodide, or X is a methosulfate counterion. The alkyl groups recited in $R_2'$ and $R_3'$ may be linear or branched, but are preferably substantially linear, or fully linear.

Particularly useful quaternary germicides include compositions presently commercially available under the tradenames BARDAC, BARQUAT, BTC, CARBOQUAT, and HYAMINE. These quaternary ammonium compounds are usually provided in a solvent, such as a C2 to C6 alcohol (such as ethanol, n-propanol, isopropanol, n-butanol, sec-butanol, and the like), glycols such as ethylene glycol, or in an mixtures containing water, such alcohols, and such glycols. Particularly preferred is didecyl dimethyl ammonium chloride, such as supplied by Lonza under tradenames such as: Bardac 2250™, Bardac 2270™, Bardac 2270E™, Bardac 2280™, and/or a blend of alkyl, preferably C12-C18, dimethyl benzyl ammonium chloride and alkyl, preferably C12-C18, dimethyl ethylbenzyl ammonium chloride, such as supplied by Lonza under the brand names: Barquat 4280Z™. In preferred embodiments, the alkyl dimethyl benzyl ammonium chloride and alkyl dimethyl ethylbenzyl ammonium chloride are present in a ratio of from 20:80 to 80:20, or 40:60 to 60:40, with a ratio of 50:50 being the most preferred.

Other suitable, but less preferred, antimicrobial agents include germicidal amines, particularly germicidal triamines such as LONZA-BAC 12, (ex. Lonza, Inc., Fairlawn, N.J. and/or from Stepan Co., Northfield Ill., as well as other sources).

In the cleaning compositions according to the invention, the antimicrobial agent, preferably quaternary ammonium compound, is required to be present in amounts which are effective in exhibiting satisfactory germicidal activity—against selected bacteria sought to be treated by the cleaning compositions. Such efficacy may be achieved against less resistant bacterial strains with only minor amounts of the quaternary ammonium compounds being present, while more resistant strains of bacteria require greater amounts of the quaternary ammonium compounds in order to destroy these more resistant strains. As such, the quaternary ammonium compound need only be present in germicidally effective amounts, which can be as little as 0.001 wt % to less than 20 wt %. In more preferred compositions, the hard surface cleaning composition comprises the antimicrobial agent at a level of from 0.05 wt % to 1.8 wt %, preferably from 0.1 wt % to 1.75 wt %, more preferably from 0.5% to 1.5 by weight of the composition, for improved shine in addition to germicidal efficacy.

A germicidally effective amount of the antimicrobial agent is considered to result in at least a log 5 reduction of *Staphylococcus aureus*, using the method of EN1276 (Chemical Disinfectants Bactericidal Activity Testing), with a contact time of less than 3 minutes.

Amine Oxide Surfactant:

Suitable amine oxide surfactants can have the formula: $R_1R_2R_3NO$ wherein each of $R_1$, $R_2$ and $R_3$ is independently a saturated or unsaturated, substituted or unsubstituted, linear or branched hydrocarbon chain of from 1 to 30 carbon atoms. Preferred amine oxide surfactants to be used according to the present invention are amine oxides having the following formula: $R_1R_2R_3NO$ wherein $R_1$ is an hydrocarbon chain comprising from 1 to 30 carbon atoms, preferably from 6 to 20, more preferably from 8 to 16 and wherein $R_2$ and $R_3$ are independently saturated or unsaturated, substituted or unsubstituted, linear or branched hydrocarbon chains comprising from 1 to 4 carbon atoms, preferably from 1 to 3 carbon atoms, and more preferably are methyl groups.

$R_1$ may be a saturated or unsaturated, substituted or unsubstituted linear or branched hydrocarbon chain.

Suitable amine oxides for use herein are for instance preferably $C_{12}$-$C_{14}$ dimethyl amine oxide, commercially available from Albright & Wilson, $C_{12}$-$C_{14}$ amine oxides commercially available under the trade name Genaminox® LA from Clamant or AROMOX® DMC from AKZO Nobel. Typically, the liquid composition herein may comprise from 0.01% to 10.0% by weight of the total composition of the amine oxide surfactant.

Surprisingly, it has been found that when the amine oxide is present in the antimicrobial liquid compositions at a level of from 0.1 wt % to 5 wt %, more preferably from 0.30 to 3.5 wt %, even more preferably 0.50 to 2.5 wt % of amine oxide surfactant, grease cleaning is improved, while the antimicrobial efficacy is maintained.

Additional Non-ionic Surfactant:

The composition comprises an additional non-ionic surfactant, comprising an alkoxylated nonionic surfactant. The alkoxylated nonionic surfactant can be present at a level of greater than 50%, more preferably greater than 75%, even more preferably greater than 90% by weight of the additional non-ionic surfactant. Most preferably, the additional non-ionic surfactant consists essentially of alkoxylated non-ionic surfactant.

Suitable alkoxylated nonionic surfactants herein to be mentioned are primarily $C_6$-$C_{16}$ alcohol polyglycol ether i.e. ethoxylated alcohols having 6 to 16 carbon atoms in the alkyl moiety and 4 to 30 ethylene oxide (EO) units. When referred to for example $C_{9-14}$ it is meant average carbons and alternative reference to for example EO8 is meant average ethylene oxide units.

Suitable alkoxylated nonionic surfactants are according to the formula RO-$(A)_n$H, wherein: R is a $C_6$ to $C_{18}$, preferably a $C_8$ to $C_{16}$, more preferably a $C_9$ to $C_{11}$ alkyl chain, or a $C_6$ to $C_{28}$ alkyl benzene chain; A is an ethoxy or propoxy or butoxy unit or a mixture thereof; and wherein n is from 1 to 30, preferably from 1 to 15 and, more preferably from 4 to 12 even more preferably from 5 to 10. Preferred R chains for use herein are the $C_8$ to $C_{22}$ alkyl chains. Even more preferred R chains for use herein are the $C_9$ to $C_{12}$ alkyl chains. Non-capped ethoxy/butoxylated, ethoxy/propoxylated, butoxy/propoxylated and ethoxy/butoxy/propoxylated nonionic surfactants may also be used herein. Preferred non-capped alkoxylated nonionic surfactants are non-capped ethoxylated nonionic surfactants.

Suitable non-capped ethoxylated nonionic surfactants for use herein are Dobanol® 91-2.5 (HLB=8.1; R is a mixture of $C_9$ and $C_{11}$ alkyl chains, n is 2.5), Dobanol® 91-10 (HLB=14.2; R is a mixture of $C_9$ to $C_{11}$ alkyl chains, n is 10), Dobanol® 91-12 (HLB=14.5; R is a mixture of $C_9$ to $C_{11}$ alkyl chains, n is 12), Lialethl® 11-5 (R is a $C_{11}$ alkyl chain, n is 5), Isalchem® 11-5 (R is a mixture of linear and branched C11 alkyl chain, n is 5), Isalchem® 111 (R is a mixture of linear and branched C11 alkyl chain, n is 8), Lialethl® 11-21 (R is a mixture of linear and branched $C_{11}$ alkyl chain, n is 21), Isalchem® 11-21 (R is a $C_{11}$ branched alkyl chain, n is 21), Empilan® KBE21 (R is a mixture of $C_{12}$ and $C_{14}$ alkyl chains, n is 21) or mixtures thereof. Preferred herein are Dobanol® 91-5, Neodol® 11-5, Neodol® 91-6, Neodol® 91-8, Neodol® 45-7, Lialethl® 11-21, Lialethl® 11-5, Lialet® 111-8, Lialet® 123-8, Isalchem® 11-5 Isalchem® 11-21 Dobanol® 91-8, or Dobanol® 91-10, or Dobanol® 91-12, Marilpal® 10-8, Marilpal® 24-7, propylheptanol EO8, or mixtures thereof. These Dobanol®/Neodol® surfactants are commercially available from SHELL. These Lutensol® surfactants are commercially available from BASF and these Tergitol® surfactants are commercially available from Dow Chemicals. Methyl Ester Ethoxylates, such as those sold under the Greenbentin® tradename by Kolb, are also suitable.

Suitable chemical processes for preparing the alkoxylated nonionic surfactants for use herein include condensation of corresponding alcohols with alkylene oxide, in the desired proportions. Such processes are well known to the person skilled in the art and have been extensively described in the art.

Preferably, said alkoxylated nonionic surfactant is selected from the group consisting of alkoxylated nonionic surfactants and mixtures thereof. More preferably, said alkoxylated nonionic surfactant is a $C_{9-11}$ EO5 alkylethoxylate, $C_{12-14}$ EO5 alkylethoxylate, a $C_{11}$ EO5 alkylethoxylate, $C_{12-14}$ EO21 alkylethoxylate, $C_{9-11}$ EO8 alkylethoxylate, or a mixture thereof. Most preferably, said alkoxylated nonionic surfactant is a $C_{11}$ EO5 alkylethoxylate, a $C_{9-11}$ EO8 alkylethoxylate, a $C_{10}$ EO8 alkylethoxylate, and mixtures thereof.

Preferred alkoxylated nonionic surfactant have a chain length of $C_{11}$ or less. It has been found that such alkoxylated nonionic surfactants, having a chain length of $C_{11}$ or less, provide improved grease penetration while maintaining the efficacy of the antimicrobial agent.

Alkyl polyglycosides are biodegradable nonionic surfactants which are well known in the art, and can also be used in the compositions of the present invention. However, they are less preferred. Alkyl polyglycosides typically have the general formula $C_nH_{2n+1}O(C_6H_{10}O_5)_x$ H wherein n is preferably from 9 to 16, more preferably 11 to 14, and x is preferably from 1 to 2, more preferably 1.3 to 1.6.

Typically, the composition comprises greater than 2.0% by weight of the total composition of said additional non-ionic surfactant, preferably greater than 3.5%, more preferably greater than 5.0% by weight of additional non-ionic surfactant.

It has been found that high levels of additional non-ionic surfactant can reduce the availability of the antimicrobial agent present as free monomer. As such, the composition preferably comprises less than 20%, preferably less than 15%, more preferably less than 12%, still more preferably less than 9% by weight of the composition of additional non-ionic surfactant.

For improved grease removal and high antimicrobial efficacy, the ratio of amine oxide surfactant to the sum of amine oxide surfactant and additional non-ionic surfactant is from 0.05 to 0.5, preferably from 0.1 to 0.4, more preferably from 0.2 to 0.35.

Anionic Surfactant:

The liquid hard surface cleaning composition can comprise less than 1.0 wt % of an anionic surfactant, or up to 0.1 wt % of anionic surfactant. In most preferred embodiments, the composition is essentially free, or free of, anionic surfactant. The anionic surfactant can be selected from the group consisting of: an alkyl sulphate, an alkyl alkoxylated sulphate, a sulphonic acid or sulphonate surfactant, and mixtures thereof.

If anionic surfactant is used, alkyl ethoxylated sulphates, especially those with an ethoxylation degree of 1 to 8, preferably 2 to 5, are preferred, since they cause little or no haziness.

Suitable alkyl sulphates for use herein include water-soluble salts or acids of the formula $ROSO_3M$ wherein R is a $C_6$-$C_{18}$ linear or branched, saturated or unsaturated alkyl group, preferably a $C_8$-$C_{16}$ alkyl group and more preferably a $C_{10}$-$C_{16}$ alkyl group, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like).

Linear alkyl sulphates include $C_{12-14}$ alkyl sulphate like EMPICOL® 0298/, EMPICOL® 0298/F or EMPICOL® XLB commercially available from Huntsman.

Sulphonated anionic surfactants include all those commonly known by those skilled in the art, such as those selected from the group consisting of: alkyl sulphonates; alkyl aryl sulphonates; naphthalene sulphonates; alkyl alkoxylated sulphonates; linear alkyl benzene sulphonates, and $C_6$-$C_{16}$ alkyl alkoxylated linear or branched diphenyl oxide disulphonates; and mixtures thereof. Exemplary surfactants are $C_{12}$-$C_{18}$ alkyl polyethoxylate (1.0) sulphonate ($C_{12}$-$C_{18}$E(1.0)SM), $C_{12}$-$C_{18}$ alkyl polyethoxylate (2.25) sulphonate ($C_{12}$-$C_{18}$E(2.25)SM), $C_{12}$-$C_{18}$ alkyl polyethoxylate (3.0) sulphonate ($C_{12}$-$C_{18}$E(3.0)SM), and $C_{12}$-$C_{18}$ alkyl polyethoxylate (4.0) sulphonate ($C_{12}$-$C_{18}$E(4.0)SM), wherein M is conveniently selected from sodium and potassium. Particularly suitable alkoxylated sulphonates include alkyl aryl polyether sulphonates like Triton X-200® commercially available from Dow Chemical.

Exemplary sulphated or sulphonated anionic surfactant can be selected from the group consisting of alkyl sulphates (AS) preferably $C_{12}$, $C_{13}$, $C_{14}$ and $C_{15}$ AS, sodium linear alkyl sulphonate (NaLAS), linear alkyl benzene sulphonate, sodium paraffin sulphonate $NaPC_{12-16}S$, and mixtures thereof.

Additional Surfactant:

The hard surface cleaning composition may comprise up to 15% by weight of an additional surfactant, preferably selected from: an amphoteric, zwitterionic, and mixtures thereof. More preferably, the hard surface cleaning composition can comprise from 0.5% to 5%, or from 0.5% to 3%, or from 0.5% to 2% by weight of the additional surfactant.

Suitable zwitterionic surfactants typically contain both cationic and anionic groups in substantially equivalent proportions so as to be electrically neutral at the pH of use, and are well known in the art. Some common examples of zwitterionic surfactants (such as betaine/sulphobetaine surfacants) are described in U.S. Pat. Nos. 2,082,275, 2,702,279 and 2,255,082.

Amphoteric surfactants can be either cationic or anionic depending upon the pH of the composition. Suitable amphoteric surfactants include dodecylbeta-alanine, N-alkyltaurines such as the one prepared by reacting dodecylamine with sodium isethionate, as taught in U.S. Pat. No. 2,658,072, N-higher alkylaspartic acids such as those taught in U.S. Pat. No. 2,438,091, and the products sold under the trade name "Miranol", as described in U.S. Pat. No. 2,528,378. Other suitable additional surfactants can be found in McCutcheon's Detergents and Emulsifers, North American Ed. 1980.

Thickener

The liquid hard surface cleaning composition according to the present invention can further comprise a thickener. A thickener provides a higher viscosity cleaning composition which gives longer contact time and therefore more time for the composition to penetrate into the greasy soil and/or particulated greasy soil to improve cleaning effectiveness. A thickener can also improve product stability.

Suitable thickeners are herein include polyacrylate based polymers, preferably hydrophobically modified polyacrylate polymers; hydroxyl ethyl cellulose, preferably hydrophobically modified hydroxyl ethyl cellulose, xanthan gum, hydrogenated castor oil (HCO) and mixtures thereof.

Preferred thickeners are polyacrylate based polymers, preferably hydrophobically modified polyacrylate polymers. Preferably a water soluble copolymer based on main monomers acrylic acid, acrylic acid esters, vinyl acetate, methacrylic acid, acrylonitrile and mixtures thereof, more preferably copolymer is based on methacrylic acid and acrylic acid esters having appearance of milky, low viscous dispersion. Most preferred hydrologically modified polyacrylate polymer is Rheovis® AT 120, which is commercially available from BASF.

Other suitable thickeners are hydroxethylcelluloses (HM-HEC) preferably hydrophobically modified hydroxyethylcellulose.

Suitable hydroxethylcelluloses (HM-HEC) are commercially available from Aqualon/Hercules under the product name Polysurf 76® and W301 from 3V Sigma.

Xanthan gum is one suitable thickener used herein. Xanthan gum is a polysaccharide commonly used rheoligy modifier and stabilizer. Xanthan gum is produced by fermentation of glucose or sucroce by the *Xanthomonas campestris* bacterium.

Suitable Xanthan gum is commercially available under trade anem Kelzan T® from CP Kelco.

Hydrogenated castor oil is one suitable thickener used herein. Suitable hydrogenated castor oil is available under trade name THIXCIN R from Elementis.

The most preferred thickener used herein are hydrophobic alkali swellable emulsion (HASE) thickeners. As such, the liquid hard surface cleaning composition preferably comprises from 0.1% to 10.0% by weight of the total composition of said thickener, preferably from 0.2% to 5.0%, more preferably from 0.2% to 2.5% and most preferably from 0.2% to 2.0%.

An increased viscosity, especially low shear viscosity, provides longer contact time, especially on inclined surfaces, and therefore improved penetration of greasy soil and/or particulated greasy soil. As a result, an increased viscosity improves cleaning and antimicrobial efficacy, especially when applied neat to the surface to be treated. Moreover, a high low shear viscosity improves the phase stability of the liquid cleaning composition, and especially improves the stability of the copolymer in compositions in the liquid hard surface cleaning composition. Hence, preferably, the liquid hard surface cleaning composition, comprising a thickener, has a viscosity of from 50 Pa·s to 1200 Pa·s, more preferably 100 Pa·s to 800 Pa·s, most preferably 200 Pa·s to 600 Pa·s, at 20° C. when measured with a AD1000 Advanced Rheometer from Atlas® shear rate 10 $s^{-1}$ with a coned spindle of 40 mm with a cone angle 2° and a truncation of ±60 μm.

The polyacrylate based polymers, preferably hydrophobically modified alkali swellable emulsion (HASE), comprises a thickening polymer, the thickening polymer comprising the following monomers:

(a) greater than 10 mol % of a carboxylic acid containing monomer;

(b) less than 90 mol % of an alkyl (meth)acrylate monomer;

(c) 0 to 3 mol %, preferably 0.1 to 2 mol %, more preferably 0.5 to 2 mol % of an associative monomer according to formula (I) or formula (II):

$$R_1—CH=CH—COO—(CH_2CH_2O)_n—R_2 \quad \text{formula (I)}$$

$$R_1—CH=CH—R_3—NH—COO—(CH_2CH_2O)_n—R_2 \quad \text{formula (II)}$$

in which:

(i) $R_1$ is H, C or COOH;

(ii) $R_2$ is a C8-C30 alkyl chain, preferably aliphatic, preferably saturated, preferably linear;

(iii) n is an integer between 2 and 150, preferably between 2 and 50, more preferably between 8 and 30, most preferably between 10 and 26; and (iv) $R_3$ is a C1-12 alkyl chain, which can be linear, branched, aromatic or combinations thereof;

For improved transparency, the carboxylic acid containing monomer is preferably present at a level greater than 20 mol %, more preferably 25 mol %, even more preferably greater than 35 mol % of the thickening polymer. The carboxylic acid containing monomer can be selected from the group consisting of: acrylic acid, methacrylic acid, itaconic acid or maleic acid, and mixtures thereof. For improved thickening, the carboxylic acid containing monomer is preferably present at the level of less than 80 mol %, more preferably less than 75 mol %, even more preferably 65 mol %.

For improved transparency, the alkyl (meth)acrylate monomer is more preferably present at a level of less than 75 mol %, more preferably less than 65 mol % of the thickening polymer. Any suitable alkyl chain can be used, though $C_1$-$C_8$ is preferred. In more preferred embodiments, the alkyl chain is ethyl ($C_2$) or butyl ($C_4$). The alkyl chain can be attached to the (meth)acrylate group by any suitable means, though ester bonds are preferred. For improved thickening the alkyl (meth)acrylate monomer is more preferably present at a level of greater than 10 mol %, more preferably greater than 30 mol %.

The monomers of the thickening polymer sum up to 100 mol %.

The thickening polymer is preferably not crosslinked. The monomers can be randomly distributed or distributed in blocks, though random is preferred for improved thickening.

Compositions which comprise a HASE thickener, in which the thickening polymer comprises greater than 20 mol % of a carboxylic acid containing monomer, less than 80 mol % of an alkyl (meth)acrylate monomer, and 0 to 3 mol %, preferably 0.1 to 2 mol %, more preferably 0.5 mol % to 2 mol % of an associative monomer according to formula (I) or formula (II), and particularly effective at maintain the antimicrobial effect of the antimicrobial.

The thickening polymer preferably has a weight average molecular weight of from 50,000 Da to 2,000,000 Da, more preferably from 100,000 Da to 1,000,000 Da, most preferably from 300,000 Da to 600,000 Da.

Suitable hydrophobically modified alkali swellable emulsions (HASE) are sold under the various brand names by Lubrizol Corporation, Clamant, Akzo Nobel, Coatex, 3V Sigma, SEPPIC, Ashland and BASF. Particularly suited, are Rheovis AT120, Novethix L10 and Novethix HC200 (Lubrizol), Crystasense Sapphire (Clariant), Alcoguard 5800 (Akzo Nobel), Rheosolve 637 and Rheosolve 650 (Coatex), Polygel W30 (3V Sigma), Capigel98 (SEPPIC), Jaypol AT4 (Ashland), Salcare SC80 and Luvigel FIT (BASF)."

Chelating Agents

The liquid hard surface cleaning composition according to the present invention further comprises chelating agent or mixtures thereof. Suitable chelating agents, in combination with the surfactant system, improve the shine benefit.

Chelating agent can be incorporated in the compositions herein in amounts ranging from 0.05% to 5.0% by weight of the total composition, preferably from 0.1% to 3.0%, more preferably from 0.2% to 2.0% and most preferably from 0.2% to 0.4%.

Suitable phosphonate chelating agents for use herein may include ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agent to be used herein is diethylene triamine penta methylene phosphonate (DTPMP). Such phosphonate chelating agents are commercially available from Monsanto under the trade name DEQUEST®. A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Most preferred biodegradable chelating agent is L-glutamic acid N,N-diacetic acid (GLDA) commercially available under tradename Dissolvine 47S from Akzo Nobel.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraamine-hexa-acetates, ethanoldiglycines, and methyl glycine diacetic acid (MGDA), both in their acid form, or in their alkali metal, ammonium, and substituted ammonium salt forms. Particularly suitable amino carboxylate to be used herein is propylene diamine tetracetic acid (PDTA) which is, for instance, commercially available from BASF under the trade name Trilon FS® and methyl glycine di-acetic acid (MGDA). Most preferred aminocarboxylate used herein is diethylene triamine pentaacetate (DTPA) from BASF.

Further carboxylate chelating agents for use herein include salicylic acid, aspartic acid, glutamic acid, glycine, malonic acid or mixtures thereof.

Polymers

The composition according to the present invention may further comprise a polymer as highly preferred optional ingredient. It has been found that the presence of a specific polymer as described herein, when present, allows further improving the grease removal performance of the thickened liquid composition due to the specific sudsing/foaming characteristics they provide to said composition. Suitable polymers for use herein are disclosed in co-pending EP patent application EP2272942 (09164872.5) and granted European patent EP2025743 (07113156.9). The polymer can be selected from the group consisting of: a vinylpyrrolidone homopolymer (PVP); a polyethyleneglycol dimethylether (DM-PEG); a vinylpyrrolidone/dialkylaminoalkyl acrylate or methacrylate copolymers; a polystyrenesulphonate polymer (PSS); a poly vinyl pyridine-N-oxide (PVNO; a polyvinylpyrrolidone/vinylimidazole copolymer (PVP-VI); a polyvinylpyrrolidone/polyacrylic acid copolymer (PVP-AA); a polyvinylpyrrolidone/vinylacetate copolymer (PVP-VA); a polyacrylic polymer or polyacrylicmaleic copolymer; and a polyacrylic or polyacrylic maleic phosphono end group copolymer; polyalyleneimines such as polyethyleneimine, modified polyamines, and mixtures thereof.

The liquid composition can comprise from 0.005% to 5.0% by weight of the total composition of said polymer, preferably from 0.10% to 4.0%, more preferably from 0.1% to 3.0% and most preferably from 0.20% to 1.0%.

Solvent

The liquid compositions of the present invention may comprise a solvent or mixtures thereof as a preferred optional ingredient. Solvents solubilise grease and oil.

Suitable solvent is selected from the group consisting of: ethers and diethers having from 4 to 14 carbon atoms; glycols or alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof. Ethers such as n-butoxypropanol and glycol ethers such as dipropylene glycol n-butyl ether are particularly preferred. Because of the improved grease cleaning efficacy of the compositions of the present invention, if present such solvents are preferably present at a level of less than 3.0 wt %, or from 0.1 wt % to 3.0 wt %, or 0.2 wt % to 2.5 wt %, or 0.5 wt % to 2.0 wt %.

Other Optional Ingredients:

The thickened liquid compositions according to the present invention may comprise a variety of other optional ingredients depending on the technical benefit aimed for and the surface treated. Suitable optional ingredients for use herein include builders, buffers, hydrotropes, colorants, stabilisers, radical scavengers, abrasives, soil suspenders, dye transfer agents, brighteners, anti dusting agents, dispersants, dye transfer inhibitors, pigments, silicones, perfumes, and/or dyes.

Method of Cleaning a Surface:

The liquid hard surface cleaning compositions described herein are particularly suited for cleaning surfaces selected from the group consisting of: glazed or non-glazed ceramic tiles, enamel, stainless steel, Inox®, Formica®, vinyl, no-wax vinyl, linoleum, melamine, glass, plastics and plastified wood, and combinations thereof. In particular, the compositions are particularly suited for reducing or removing antimicrobial activity, while leaving surfaces clean, shiny and grease free.

For general cleaning, especially of floors, the preferred method of cleaning comprises the steps of:

a) diluting a liquid hard surface cleaning described herein, to a dilution level of from 0.1% to 2% by volume, and b) applying the diluted composition to a hard surface.

In preferred embodiments, the liquid hard surface cleaning composition may be diluted to a level of from 0.3% to 1.5%, or 0.4% to 1.3% by volume. The liquid hard surface cleaning composition may be diluted to a level of from 0.4% to 0.6% by volume, especially where the liquid hard surface cleaning composition has a total surfactant level of greater than or equal to 5% by weight. Where the liquid hard surface cleaning composition has a total surfactant level of less than 5% by weight, the liquid hard surface cleaning composition may be diluted to a level of from 0.7% to 1.4% by volume. In preferred embodiments, the liquid hard surface cleaning composition is diluted with water.

The dilution level is expressed as a percent defined as the fraction of the liquid hard surface cleaning composition, by volume, with respect to the total amount of the diluted composition.

For example, a dilution level of 5% by volume is equivalent to 50 ml of the liquid hard surface cleaning composition being diluted to form 1000 ml of diluted composition.

The diluted composition can be applied by any suitable means, including using a mop, sponge, or other suitable implement.

The hard surface may be rinsed, preferably with clean water, in an optional further step, and also as a further step, wiped, such as with a cloth.

Alternatively, and especially for particularly dirty or greasy spots, the liquid hard surface cleaning compositions, can be applied neat to the hard surface. It is believed that the combination of amine oxide and further non-ionic surfactant, at the ratio provided herein, improves penetration and removal of the stain, and especially greasy stains, leading to improved surfactancy action and stain removal, as well as improved hygiene.

By "neat", it is to be understood that the liquid composition is applied directly onto the surface to be treated without undergoing any significant dilution, i.e., the liquid composition herein is applied onto the hard surface as described herein, either directly or via an implement such as a sponge, without first diluting the composition. By significant dilution, what is meant is that the composition is diluted by less than 10 wt %, preferably less than 5 wt %, more preferably less than 3 wt %. Such dilutions can arise from the use of damp implements to apply the composition to the hard surface, such as sponges which have been "squeezed" dry.

In another preferred embodiment of the present invention said method of cleaning a hard surface includes the steps of applying, preferably spraying, said liquid composition onto said hard surface, leaving said liquid composition to act onto said surface for a period of time to allow said composition to act, with or without applying mechanical action, and optionally removing said liquid composition, preferably removing said liquid composition by rinsing said hard surface with water and/or wiping said hard surface with an appropriate instrument, e.g., a sponge, a paper or cloth towel and the like.

The compositions of the present invention can also be used for improving surface shine, since the beading of the composition results in less residue formation on the treated surface, and also greater removal of residues when the surface is wiped.

Methods:

A) pH Measurement:

The pH is measured on the neat composition, at 25° C., using a Sartarius PT-10P pH meter with gel-filled probe (such as the Toledo probe, part number 52 000 100), calibrated according to the instructions manual.

B) Neat Shine Test:

The shine test is done by applying 6 ml/m$^2$ product diagonally on the surface of black glossy ceramic tiles (Sphinx Highlight Black, 20 cm×25 cm, ref. HO7300, supplied by Carobati, Boomsesteenweg 36, 2630 Aartselaar. Immediately after applying the product, the product is spread over the entire the surface by wiping gently with a double folded cotton cloth by drawing an M-pattern which covers the entire tile, repeat the wiping in the other direction to ensure a homogeneous coverage of the tile (horizontally-vertically-horizontally) and without lifting the cloth. After letting them dry, results are analysed by using grading scale described below.

| Grading in absolute scale: | and PSU Scale (average of 3 graders): |
|---|---|
| 0 = as new/no streaks and/or film | 0 = I see no difference |
| 1 = very slight streaks and/or film | 1 = I think there is difference |
| 2 = slight streaks and/or film | 2 = I am sure there is a slight difference |
| 3 = slight to moderate streaks and/or film | |
| 4 = moderate streaks and/or film | |

-continued

| Grading in absolute scale: | and PSU Scale (average of 3 graders): |
|---|---|
| 5 = moderate/heavy streaks and/or film<br>6 = heavy streaks and/or film | 3 = I am sure there is a difference<br>4 = I am sure there is a big difference |

C) Neat Kitchen Dirt Removal Test:

White enamel tiles (7 cm×25 cm, supplied by Emaillerie Belge SA) are used in this method. The tiles are soaked in a diluted All Purpose Cleaning composition which is free of surface modification polymers (such as current market European Mr. Propre APC liquid diluted to 2.4 volume %) overnight and rinsed thoroughly the day after with demineralised water to remove all product residues. The tiles are then completely dried.

In order to provide the soil mix, mix 7.5 g of oil mix (by weight, ⅓ peanut oil, ⅓ sunflower oil, ⅓ corn oil of Belgian brand 'Vandemoortele') and 2.5 g of HSW (Housewife Soil with Carbon Black supplied by Chem-Pack, 2261 Spring Grove Avenue, Cincinnati Ohio 45214 USA) in a 50 mL beaker for 15 minutes using a magnetic stirrer to ensure a homogeneous mixture.

Weigh each tile. Cut out the edge of a 7 ml pipette and sample around 3 to 4 ml of the soil mix. Pour the soil mix evenly onto 10 tiles. Repeat twice the sampling and pouring of soil mix.

Without squeezing, brush a paint roller (7 cm length, 6 cm diameter, made from synthetic sponge) to remove any remaining particles. With firm pressure, roll the soil in a vertical motion over the tile, then roll horizontally over the tiles. Finish with a gentle vertical roll to ensure the soil has evenly spread. Weigh each tile again and calculate the difference in mass in order to find the weight of soil mix applied to each tile. The total mass of soil mix per tile must be 0.6 g+/−0.1 g. If less than 0.5 g, add soil mix and roll once more to form a thin even layer. If the mass of soil mix per tile is greater than 0.7 g, start all over using a new tile.

Preheat an oven to 135° C. for enamel. Use a temperature probe to monitor the temperature of the oven. Start a timer when the oven reaches again 135° C. for enamel. The soil mix is polymerized by baking the tiles at 135° C. for 2 hours. Once the baking time has been reached, remove the tiles from the oven and cool them overnight in a controlled temperature/humidity cabinet (25° C./70% relative humidity).

Rinse sponges (yellow cellulose sponges. Type Z, supplied by Boma, Noorderlaan 131, 2030 Antwerpen) under running tap city water and squeeze out. The weight of the four squeezed sponge should be the same (+/−2 g). Pour 5 ml of liquid hard surface cleaning composition with a pipette onto the sponge.

Applying uniform pressure, wipe the tile in a linear motion over the tile at a frequency of 20 strokes per minute. This is preferably done using a mechanical apparatus which applies uniform pressure while wiping over the tile length at the defined number of cycles per minute. The number of strokes required to clean the tile is counted. The cleaning test is repeated at least eight times and the result averaged.

The cleaning index is calculated relative to the reference as follows:

$$\frac{\text{Av. number of strokes to clean the tile using the composition}}{\text{Av. number of strokes to clean the tile using the reference composition}} \times 100$$

D) Pure Grease Removal Test

The Pure grease removal test is carried out in a similar manner to the neat kitchen dirt removal test, except that the soil mix comprised 98% oil mix and 2% of the HSW.

EXAMPLES

The following compositions were prepared by simple mixing. Compositions A, B and D, E were of the invention, having a ratio of amine oxide surfactant to the sum of amine oxide surfactant and additional non-ionic surfactant of from 0.05 to 0.5. Compositions C and F are comparative, having a ratio of amine oxide surfactant to the sum of amine oxide surfactant and additional non-ionic surfactant of 0.8.

As can be seen from the data above, the antimicrobial compositions of the present invention provide improved grease removal and shine.

| | A % | B % | C* % |
|---|---|---|---|
| Amine Oxide C12/14[1] | 1 | 4 | 8 |
| Nonionic C10 EO8[2] | 9 | 6 | 2 |
| 50:50 Blend of alkyl dimethyl benzyl ammonium chloride and alkyl dimethyl ethylbenzyl ammonium chloride[3] | 1 | 1 | 1 |
| Citric acid | 0.3 | 0.3 | 0.3 |
| Sodium carbonate | 0.4 | 0.4 | 0.4 |
| Monoethanolamine | 0.9 | 0.9 | 0.9 |
| Diethylentriamine-penta-(methlyen-phosphonic) acid | 0.9 | 0.9 | 0.9 |
| PDMS | 0.0006 | 0.0006 | 0.0006 |
| Rheovis AT 120[4] | 1.05 | 1.05 | 1.05 |
| Perfume | 0.8 | 0.8 | 0.8 |
| pH (trimmed with NaOH) | 10.3 | 10.3 | 10.3 |
| Pure grease removal | 119 | 114 | 100 |
| Neat shine | 112 | 104 | 100 |

*Comparative reference
[1]Supplied by Huntsman
[2]Marlipal 10/8, straight chain ethoxylated nonionic surfactant, supplied by Sasol
[3]Barquat 4280Z ™, supplied by Lonza
[4]Rheovis ® AT120, a HASE rheology modifiying agent supplied by BASF.

| | D % | E % | F* % |
|---|---|---|---|
| Amine Oxide C12/14[1] | 1 | 4 | 8 |
| Nonionic C10 EO8[2] | 9 | 6 | 2 |
| Didecyl dimethyl ammonium chloride[5] | 1 | 1 | 1 |
| Citric acid | 0.3 | 0.3 | 0.3 |
| Sodium carbonate | 0.4 | 0.4 | 0.4 |
| Monoethanolamine | 0.9 | 0.9 | 0.9 |
| Diethylentriamine-penta-(methlyen-phosphonic) acid | 0.9 | 0.9 | 0.9 |
| PDMS | 0.0006 | 0.0006 | 0.0006 |
| Rheovis AT 120[5] | 1.05 | 1.05 | 1.05 |
| Perfume | 0.8 | 0.8 | 0.8 |
| pH (trimmed with NaOH) | 10.3 | 10.3 | 10.3 |
| Pure grease removal | 133 | 123 | 100 |
| Neat shine | 137 | 114 | 100 |

[5]Bardac 2270E ™, supplied by Lonza

The following compositions were prepared by simple mixing. Compositions G, H and K, L were of the invention, having a ratio of amine oxide surfactant to the sum of amine oxide surfactant and additional non-ionic surfactant of from 0.05 to 0.5.

As can be seen from the data below, the antimicrobial compositions of the present invention provide improved cleaning of neat kitchen dirt, especially for compositions comprising less than 2 wt % of antimicrobial agent.

| | G % | H % |
|---|---|---|
| Amine Oxide C12/14[1] | 2.25 | 2.25 |
| Nonionic C10 EO8[2] | 6.75 | 6.75 |
| 50:50 Blend of alkyl dimethyl benzyl ammonium chloride and alkyl dimethyl ethylbenzyl ammonium chloride[3] | 1 | 2 |
| Citric acid | 0.3 | 0.3 |
| Sodium carbonate | 0.4 | 0.4 |
| Monoethanolamine | 0.9 | 0.9 |
| Diethylentriamine-penta-(methlyen-phosphonic) acid | 0.9 | 0.9 |
| PDMS | 0.0006 | 0.0006 |
| Rheovis AT 120[5] | 1.05 | 1.05 |
| Perfume | 0.8 | 0.8 |
| pH (trimmed with NaOH) | 11.0 | 11.0 |
| Neat Kitchen Dirt | 110 | 100 |

| | I % | J % |
|---|---|---|
| Amine Oxide C12/14[1] | 2.25 | 2.25 |
| Nonionic C10 EO8[2] | 6.75 | 6.75 |
| Didecyl dimethyl ammonium chloride[4] | 1 | 2 |
| Citric acid | 0.3 | 0.3 |
| Sodium carbonate | 0.4 | 0.4 |
| Monoethanolamine | 0.9 | 0.9 |
| Diethylentriamine-penta-(methlyen-phosphonic) acid | 0.9 | 0.9 |
| PDMS | 0.0006 | 0.0006 |
| Rheovis AT 120[5] | 1.05 | 1.05 |
| Perfume | 0.8 | 0.8 |
| pH (trimmed with NaOH) | 11.0 | 11.0 |
| Neat Kitchen Dirt | 108 | 100 |

As can be seen from the data below, the compositions of the present invention provide the desired antimicrobial efficacy.

| | K % | L % | M % | N % |
|---|---|---|---|---|
| Amine Oxide C12/14[1] | 1.25 | 1.25 | 2.25 | 2.25 |
| Nonionic C10 EO8[2] | 3.75 | 3.75 | 6.75 | 6.75 |
| 50:50 Blend of alkyl dimethyl benzyl ammonium chloride and alkyl dimethyl ethylbenzyl ammonium chloride[3] | — | 0.25 | 0.80 | — |
| Didecyl dimethyl ammonium chloride[6] | 0.25 | — | — | 1.20 |
| Sodium carbonate | 0.4 | 0.4 | 0.4 | 0.4 |
| Monoethanolamine | 0.9 | 0.9 | 0.9 | 0.9 |
| Rheovis AT 120[5] | — | 0.5 | — | 1.0 |
| pH (trimmed with NaOH) | 11.1 | 11.1 | 11.1 | 11.1 |
| log reduction of *staphylococcus aureus*, using the method of EN1276 (Chemical Disinfectants Bactericidal Activity Testing), in less than 3 minutes | >5 | >5 | >5 | >5 |

[6]Bardac 2280R ™, supplied by Lonza

The following are exemplary formulae of the present invention, which can be applied to hard surfaces in both neat and diluted form.

| | O % | P % | Q % | R % |
|---|---|---|---|---|
| Amine Oxide C12/14[1] | 0.5 | 0.5 | 3.5 | 1.0 |
| Nonionic C10 EO8[2] | 1.95 | 2.25 | 5.0 | 8.5 |
| 50:50 Blend of alkyl dimethyl benzyl ammonium chloride and alkyl dimethyl ethylbenzyl ammonium chloride[3] | 0.1 | — | 0.9 | — |
| Didecyl dimethyl ammonium chloride[6] | | 0.5 | — | 1.5 |
| Citric acid | 0.2 | 0.2 | 0.2 | 0.3 |
| Sodium carbonate | 0.5 | 0.5 | 0.4 | 1.0 |
| Monoethanolamine | 0.4 | 0.3 | 0.35 | 1.0 |
| Diethylentriamine-penta-(methlyen-phosphonic) acid | 0.1 | 0.2 | 0.3 | 0.5 |
| PDMS | — | — | 0.006 | 0.006 |
| Rheovis AT 120[4] | — | — | 0.9 | 1.2 |
| Perfume | 0.3 | 0.5 | 0.3 | 0.7 |
| pH (trimmed with NaOH) | 11.1 | 10.5 | 11.0 | 11.1 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A hard surface cleaning composition comprising:

a) from about 0.001 wt to less than about 2.0 wt % of an antimicrobial agent, wherein the antimicrobial agent is a quaternary ammonium compound, wherein the quaternary ammonium compound is selected from the group consisting of: didecyl dimethyl ammonium chloride, a blend of alkyl dimethyl benzyl ammonium chloride and alkyl dimethyl ethylbenzyl ammonium chloride, and mixtures thereof;

b) from about 0.50 wt % to about 5.0 wt % of a C12-C14 dimethyl amine oxide surfactant;

c) from 1.0% to 20.0% by weight of the composition, of a $C_9$-$C_{11}$ E08 alkyl ethoxylate; and d) less than about 1.0 wt % of anionic surfactant;

wherein the weight ratio of amine oxide surfactant to the sum of amine oxide surfactant and additional non-ionic surfactant is from about 0.05 to about 0.5.

2. The hard surface cleaning composition according to claim 1, wherein the weight ratio of amine oxide surfactant to the sum of amine oxide surfactant and additional nonionic surfactant is from about 0.1 to about 0.40.

3. The hard surface cleaning composition according to claim 2, wherein the weight ratio of amine oxide surfactant to the sum of amine oxide surfactant and additional nonionic surfactant is from 0.2 to 0.35.

4. The hard surface cleaning composition according to claim 1, wherein the composition comprises from about 0.50 to about 2.50 wt % of the amine oxide surfactant.

5. The hard surface cleaning composition according to claim 1, wherein the antimicrobial agent is present at a level of from about 0.05 wt % to about 1.8 wt % by weight of the composition.

6. The hard surface cleaning composition according to claim 5, wherein the antimicrobial agent is present at a level of from about 0.9% to about 1.5% by weight of the composition.

7. The hard surface cleaning composition according to claim 1, wherein the composition further comprises a solvent selected from the group consisting of: ethers and diethers having from 4 to 14 carbon atoms; glycols, alkoxylated glycols; alkoxylated aromatic alcohols; aromatic alcohols; alkoxylated aliphatic alcohols; aliphatic alcohols; $C_8$-$C_{14}$ alkyl and cycloalkyl hydrocarbons and halohydrocarbons; $C_6$-$C_{16}$ glycol ethers; terpenes; and mixtures thereof.

8. The hard surface cleaning composition according to claim 7, wherein the solvent is present at a level of less than about 3.0 wt % of the composition.

9. The hard surface cleaning composition according to claim 1, wherein the composition comprises up to about 0.1 wt % of anionic surfactant.

10. The hard surface cleaning composition according to claim 1, wherein the composition is essentially free of anionic surfactant.

11. The hard surface cleaning composition according to claim 1, wherein the $C_9$-$C_{11}$ E08 alkyl ethoxylate is present at a level of from 7.0% to 12.0% by weight of the composition.

12. The hard surface cleaning composition according to claim 1, wherein the composition further comprises a thickener.

13. The hard surface cleaning composition according to claim 12, wherein the thickener comprises one or more hydrophobic alkali swellable emulsion (HASE) thickeners.

14. A method of cleaning surfaces, comprising the steps of:

a) diluting a liquid hard surface cleaning composition according to claim 1, and b) applying the diluted composition to a hard surface.

15. A method of cleaning stained surfaces, comprising the step of:

applying neat to the stained part of a hard surface a liquid hard surface cleaning composition according to claim 1.

* * * * *